US012016457B2

(12) United States Patent
Lin

(10) Patent No.: US 12,016,457 B2
(45) Date of Patent: Jun. 25, 2024

(54) MOBILE PHONE DISPLAY STAND STRUCTURE

(71) Applicant: SENSEAGE CO., LTD., New Taipei (TW)

(72) Inventor: Ben-Tien Lin, New Taipei (TW)

(73) Assignee: SenseAGE Co., Ltd., New Taipei (TW)

( * ) Notice: Subject to any disclaimer, the term of this patent is extended or adjusted under 35 U.S.C. 154(b) by 346 days.

(21) Appl. No.: 17/647,889

(22) Filed: Jan. 13, 2022

(65) Prior Publication Data

US 2023/0034502 A1 Feb. 2, 2023

(30) Foreign Application Priority Data

Jul. 28, 2021 (CN) ..... 202121725936.2

(51) Int. Cl.
*A47B 23/04* (2006.01)
*A45C 11/00* (2006.01)

(52) U.S. Cl.
CPC ..... *A47B 23/044* (2013.01); *A45C 11/00* (2013.01); *A45C 2011/002* (2013.01); *A45C 2200/15* (2013.01)

(58) Field of Classification Search
CPC ..... A45C 11/00; A45C 2011/002; A45C 2200/15; A45C 13/005; A45C 2013/025; A47B 23/043; A47B 23/044
See application file for complete search history.

(56) References Cited

U.S. PATENT DOCUMENTS

2012/0006962 A1* 1/2012 Lin ..... F16M 11/10 248/398

* cited by examiner

*Primary Examiner* — Keith Ferguson
(74) *Attorney, Agent, or Firm* — Rosenberg, Klein & Lee

(57) ABSTRACT

A mobile device display stand structure includes: a shaft driven and rotated by applying a critical moment greater than a resistance of the shaft to overcome the resistance of the shaft; and a first lever and a second lever connected to the shaft separately. The first lever and the second lever use the shaft as a fulcrum and flip over relative to each other by the shaft to define an included angle, and the first lever and the second lever are plate-shaped bodies. When the included angle is 0-180 degrees, the gravity of the first lever generates a first moment relative to the shaft or the gravity of the second lever generates a second moment smaller than the critical moment relative to the shaft, such that the first lever or the second lever cannot be rotated relative to the shaft and the included angle is kept constant.

13 Claims, 8 Drawing Sheets

MOBILE PHONE DISPLAY STAND STRUCTURE

FIELD OF THE INVENTION

The present invention relates to the field of object supporting structures, and more particularly to an object supporting structure that can be formed by bending, so that users can put an object (such as a mobile device) on the object supporting structure to facilitate the users to view the object.

BACKGROUND OF THE INVENTION

As the mobile communication technology advances in recent years, various mobile devices such as mobile phones and tablet PCs have become essential items for daily life. However, the mobile devices are often used for watching videos, querying information, or operating social networking websites, etc., most of these applications require users to view or operate a mobile device while holding it, thereby causing a lot of inconvenience.

In addition, when the users are working, the mobile device can only be placed flatly on the desktop, which makes it difficult for the users to view the screen, or to control the screen at an inconvenient angle. The users often cannot pay attention to new messages received by the mobile device at any time, thereby causing delay and inconvenience of communications.

SUMMARY OF THE INVENTION

In view of the aforementioned drawback of the prior art, the inventor of the present invention based on years of experience in the related industry to conduct extensive research and experiment, and finally developed a mobile phone display stand structure capable of fixing and supporting the mobile device to improve the convenience of viewing the mobile device. In addition, the structure of this invention can also fix other objects to facilitate users to view the objects.

To achieve the aforementioned and other objectives, the present invention discloses a mobile device display stand structure including: a shaft driven and rotated by applying a critical moment greater than a resistance of the shaft to overcome the resistance of the shaft; and a first lever and a second lever connected to the shaft separately, and the first lever and the second lever uses the shaft as a fulcrum to flip over relative to each other to define an included angle, and the first lever and the second lever are plate-shaped bodies.

When the included angle falls within a range of 0-180 degrees, the gravity of the first lever generates a first moment relative to the shaft or the gravity of the second lever generates a second moment smaller than the critical moment relative to the shaft, such that the first lever or the second lever cannot be rotated relative to the shaft and the included angle is kept constant.

In some embodiments, the mobile device display stand structure further includes a bending portion, and the first lever is connected to the bending portion by a flexible portion, and the bent first lever and the bending portion are attached and fixed to each other by a non-permanent fixing method.

In some embodiments, the bending portion includes an extension part disposed at an end of the bending portion where the bending portion and the first lever are connected.

In a supporting state, the included angle is greater than 0 degree, a plane of the bending portion is flatly attached to a horizontal surface, and the bending portion is not attached to the first lever. In another supporting state, the included angle is greater than 0 degree, a plane of the bending portion is attached to the first lever, and a section of the extension part abuts against a horizontal plane.

In the present invention, the first lever, the second lever and the bending portion have a magnetic part separately. In some embodiments, the present invention further includes an add-on part connected and fixed to the first lever or the second lever by a non-permanent fixing method In another embodiment, the mobile device display stand structure of the present invention includes: a shaft driven and rotated by applying a critical moment greater than a resistance of the shaft to overcome the resistance of the shaft; and a first lever and a second lever connected to the shaft separately, and the first lever and the second lever uses the shaft as a fulcrum to flip over relative to each other to define an included angle, and the first lever and the second lever are plate-shaped bodies.

When the mobile device display stand structure is placed on a plane and the included angle falls within a range of 0-180 degrees, the sum of a first moment relative to the shaft generated by a resistance greater than the gravity of the first lever, and a second moment relative to the shaft generated by the gravity of the second lever makes the first lever or the second lever unable to rotate relative to the shaft and keeps the included angle constant, wherein the mobile device display stand structure further comprises a bending portion, and the first lever is coupled to the bending portion by a flexible portion, and the bent first lever and the bending portion are attached and fixed to each other by a non-permanent fixing method.

In summation, the mobile device display stand structure disclosed by the present invention is a supporting stand structure can be folded and unfolded quickly and changed to an erected state by users after positioning and fixing the stand structure. Unlike other supporting structures, the first and second levers of the structure of present invention can be unfolded into any angle (within a range of 0-180 degrees) to form a supporting structure with different heights and angles, and the users can freely adjust the angle. The present invention can also permanently maintain the supporting angle to improve convenience and practicality.

DESCRIPTION OF THE PREFERRED EMBODIMENTS

The technical contents of the present invention will become apparent with the detailed description of preferred embodiments accompanied with the illustration of related drawings as follows. It is intended that the embodiments and figures disclosed herein are to be considered illustrative rather than restrictive.

The non-permanent fixing method described in this invention refers to the method of fixing, binding or connecting two objects to each other by means of magnetism, Velcro tape, detachable clamping mechanism, or repetitive adhesive glue, etc. and the fixation, connection, binding or coupling of two objects can be released at any time. The permanent fixing method described in this invention refers to the method of fixing, connecting, binding or joining two objects to each other by means of non-repetitive glue, sewing, or nailing, etc.

The term "plate-shaped body" described in this specification refers to an object with a length and a width much greater than its thickness, so that the object is substantially a flat two-dimensional object, but the object still has a specific thickness.

The term "magnetic part' described in this specification refers to any magnet or metal that can attract ferrite magnets, Al—Ni—Co alloy magnets, rare earth magnets, etc.

Figure 1:
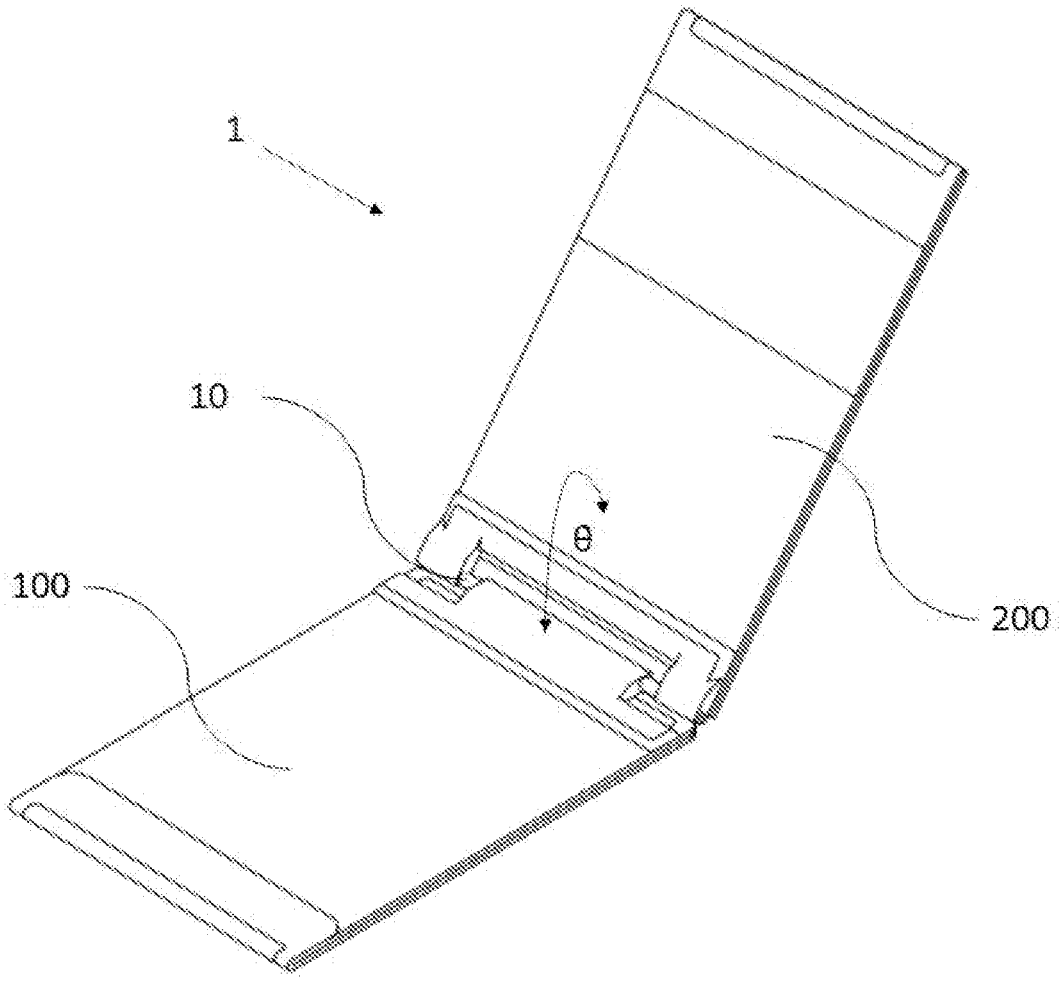
FIG. 1 is a schematic view showing an unfolded state of the structure in accordance with an embodiment of the present invention.
Figure 2:
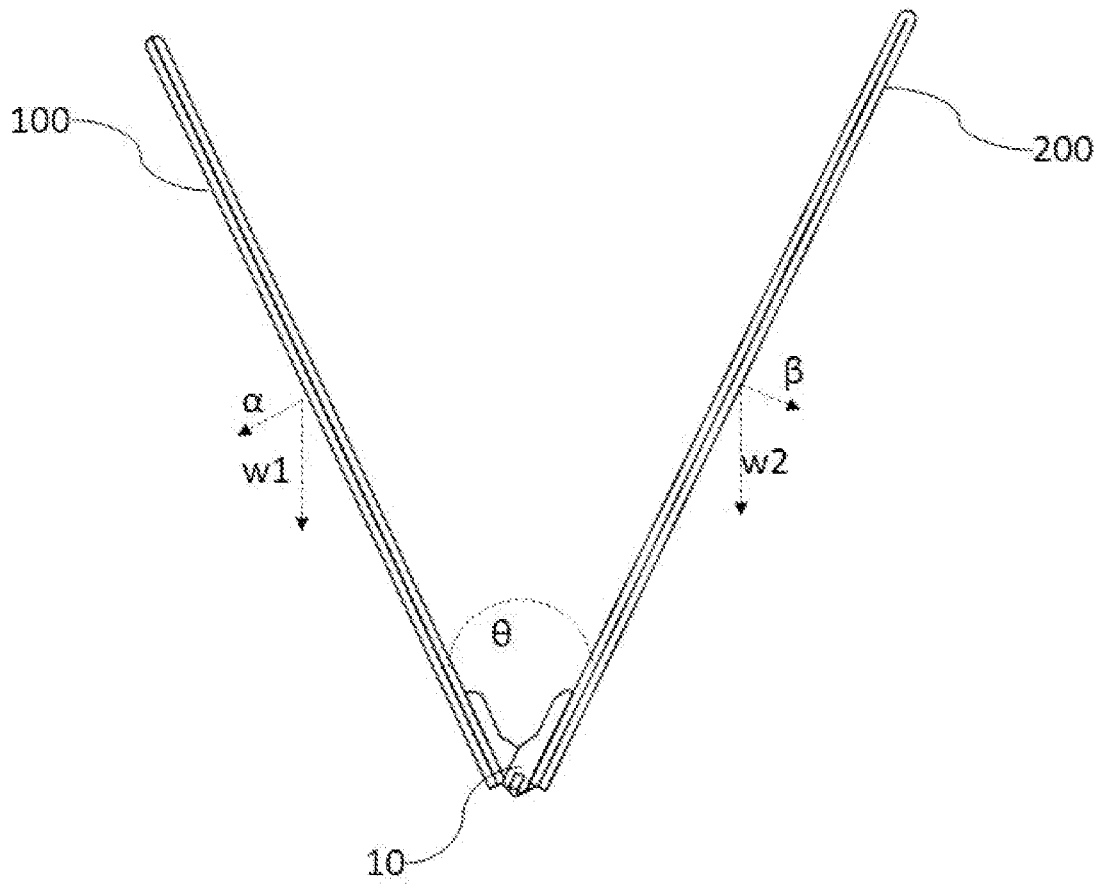
FIG. 2 is a side view showing an unfolded state of the structure in accordance with an embodiment of the present invention.

With reference to FIGS. 1 to 9 for the schematic views of the structures and the states of various operations and applications of various embodiments of the present invention respectively, a mobile device display stand structure 1 of the present invention as shown in FIG. 1 includes: a shaft 10, a first lever 100, and a second lever 200. The first lever 100 and the second lever 200 are connected to the shaft 10 separately, and the first lever 100 and the second lever 200 use the shaft 10 as a fulcrum to flip over relative to each other by the shaft 10 to define an included angle θ between the first lever 100 and the second lever 200. The first lever 100 and the second lever 200 are plate-shaped bodies. In order to support an object at various angles and heights, the present invention adds a resistance to the shaft 10, such that the users need to apply a critical moment greater than a resistance of the shaft to overcome the resistance of the shaft 10 and rotate the shaft 10. In this specification, the critical moment refers to a minimum moment capable of driving the shaft 10 to rotate. Regardless of any included angle, the resistance of the shaft 10 can keep the included angle θ constant without having any other external force source as long as the included angle θ falls within the range of 0-180 degrees. In FIG. 2, when the included angle θ falls within the range of 0-180 degrees, the gravity w1 of the first lever 100 generates a first moment α (wherein the arm of force is the first lever 100 itself relative to the shaft 10); the gravity w2 of the second lever 200 generates a second moment β relative to the shaft 10 (wherein the arm of force arm is the second lever 200 itself). The first moment α or second moment β is smaller than the critical moment, such that the first lever 100 or the second lever 200 cannot be rotated relative to the shaft 10, and the included angle θ is kept constant. It is noteworthy that the moment generated by the gravity of the first lever 100 or the gravity of the second lever 200 relative to the shaft 10 depends on the space orientation of the first lever 100 or the second lever 200. For example, when the first lever 100 is perpendicular to a horizontal plane, the first moment α is equal to 0. In the present invention, regardless of the space orientation of the first lever 100 or the second lever 200, the first moment α or the second moment β is smaller than the critical moment, so that the mobile device display stand structure can maintain a constant included angle.

In another embodiment, when the mobile device display stand structure 1 is placed on a plane and the included angle falls within the range of 0-180 degrees, the sum of a first moment α generated by the resistance greater than the gravity w1 of the first lever 100 relative to the shaft 10 and a second moment β generated by the gravity w2 of the second lever 200 relative to the shaft 10 makes the first lever 100 or the second lever 200 unable to rotate relative to the shaft 10 and keeps the included angle constant.

Figure 3:
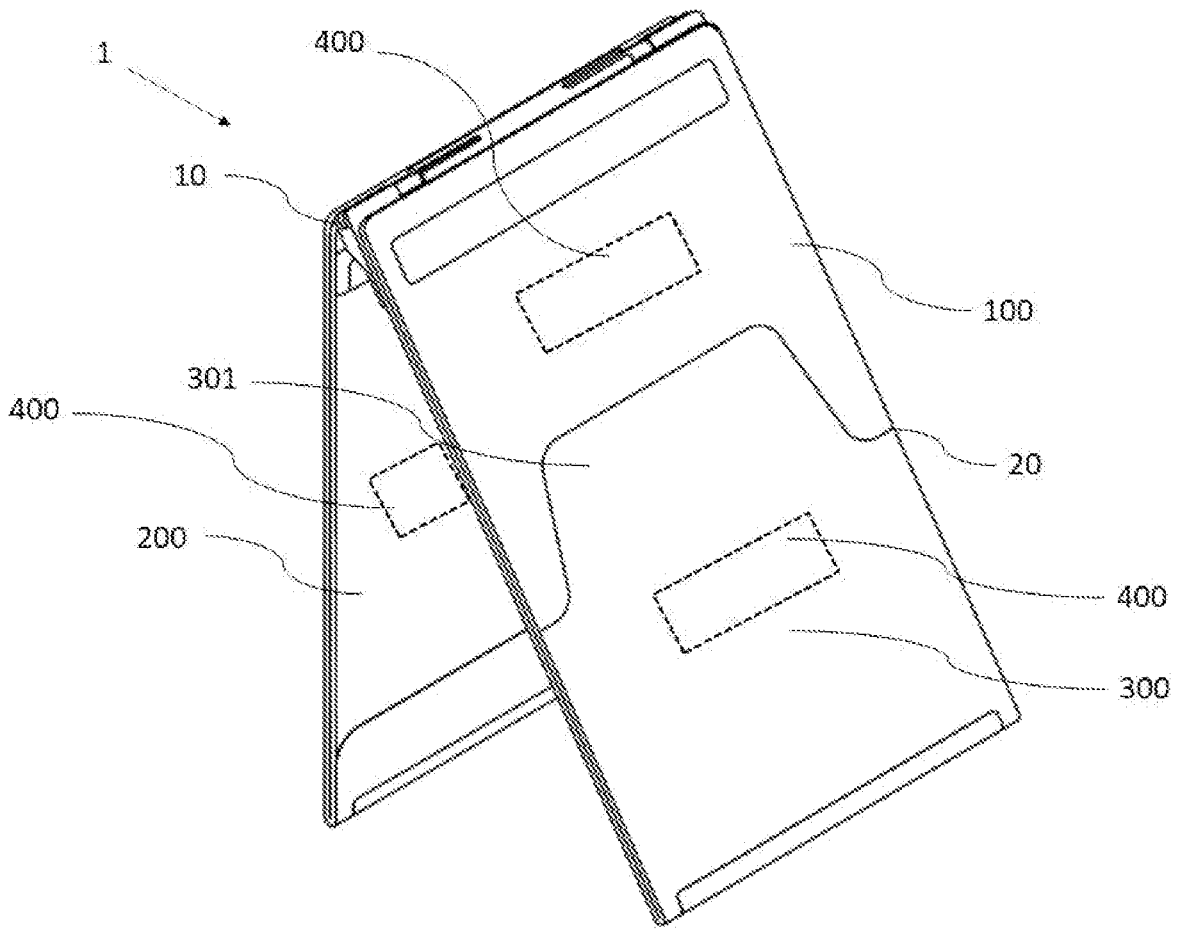
FIG. 3 is a side view showing an unfolded state of the structure in accordance with another embodiment of the present invention.
Figure 4:
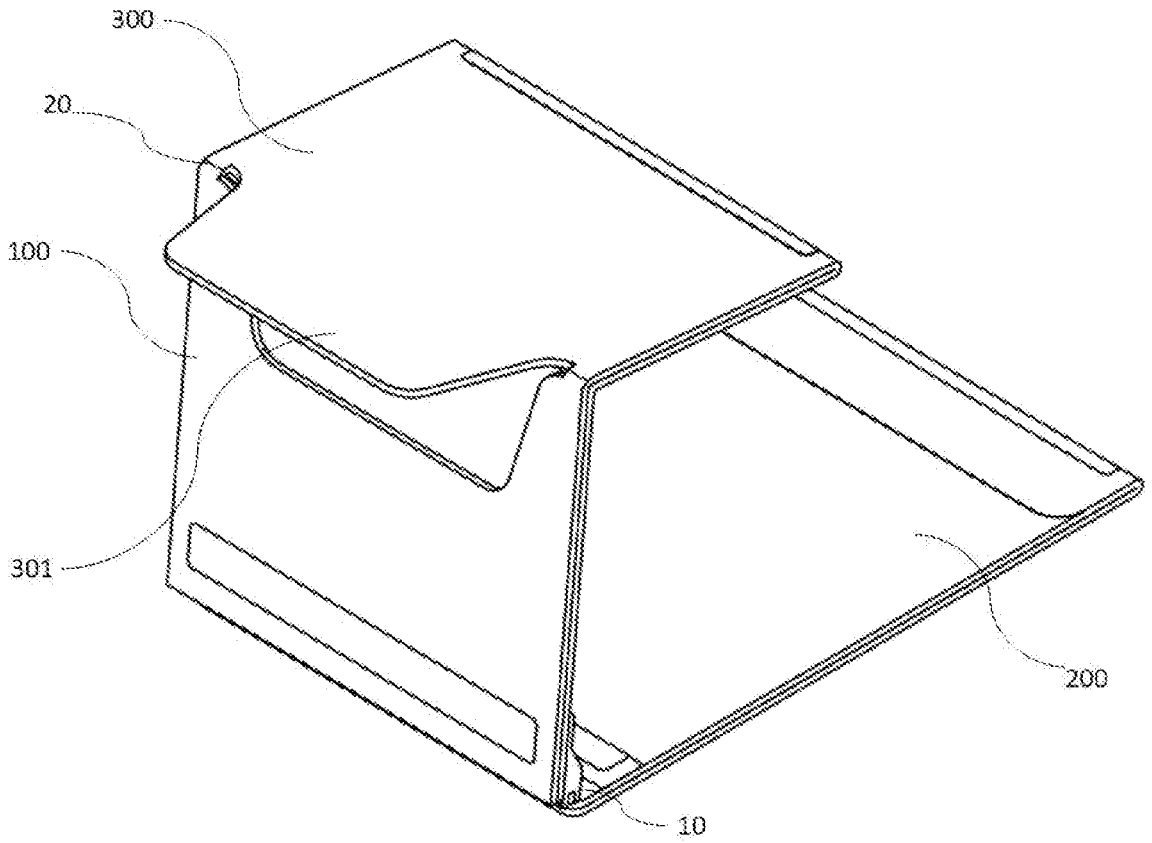
FIG. 4 is a schematic view showing a state of bending a bending portion by a flexible portion in accordance with an embodiment of the present invention.
Figure 5:
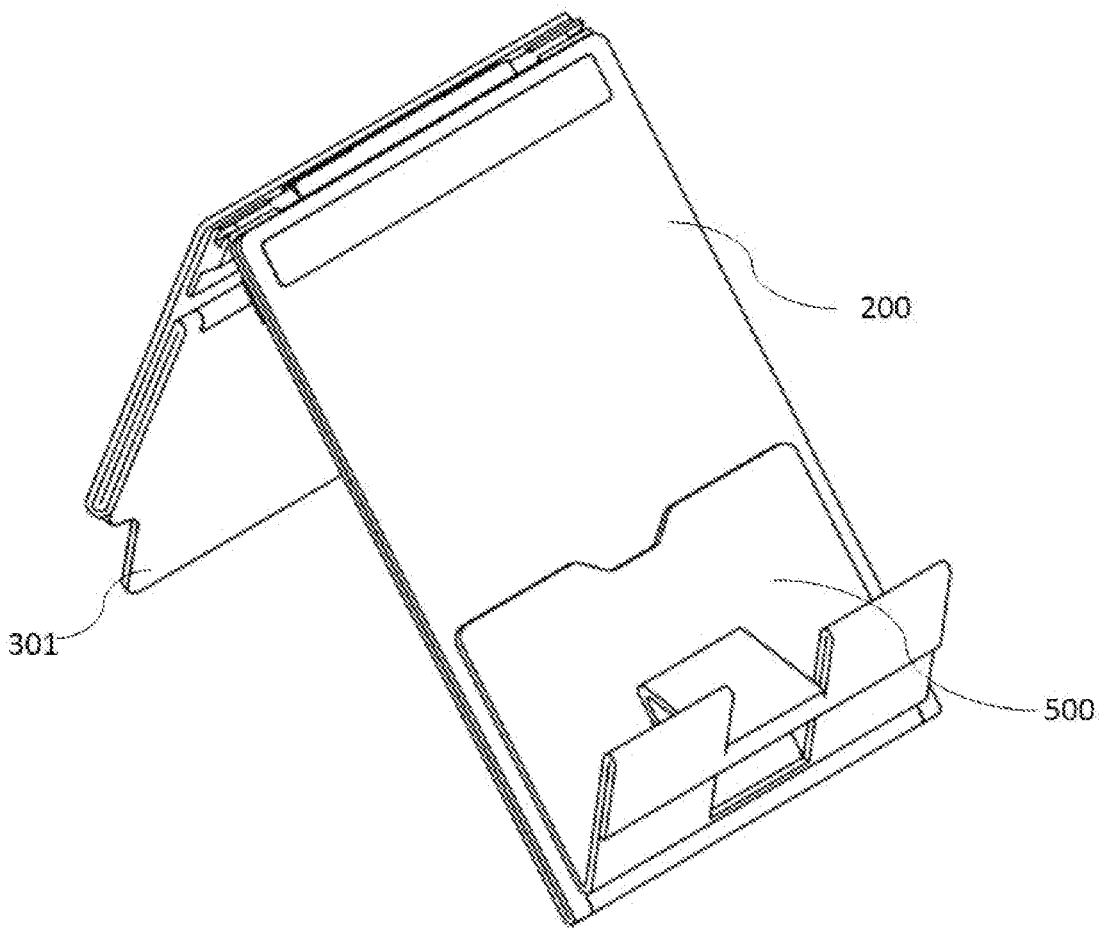
FIG. 5 is a schematic view showing a state of use in accordance with an embodiment of the present invention.
Figure 7:
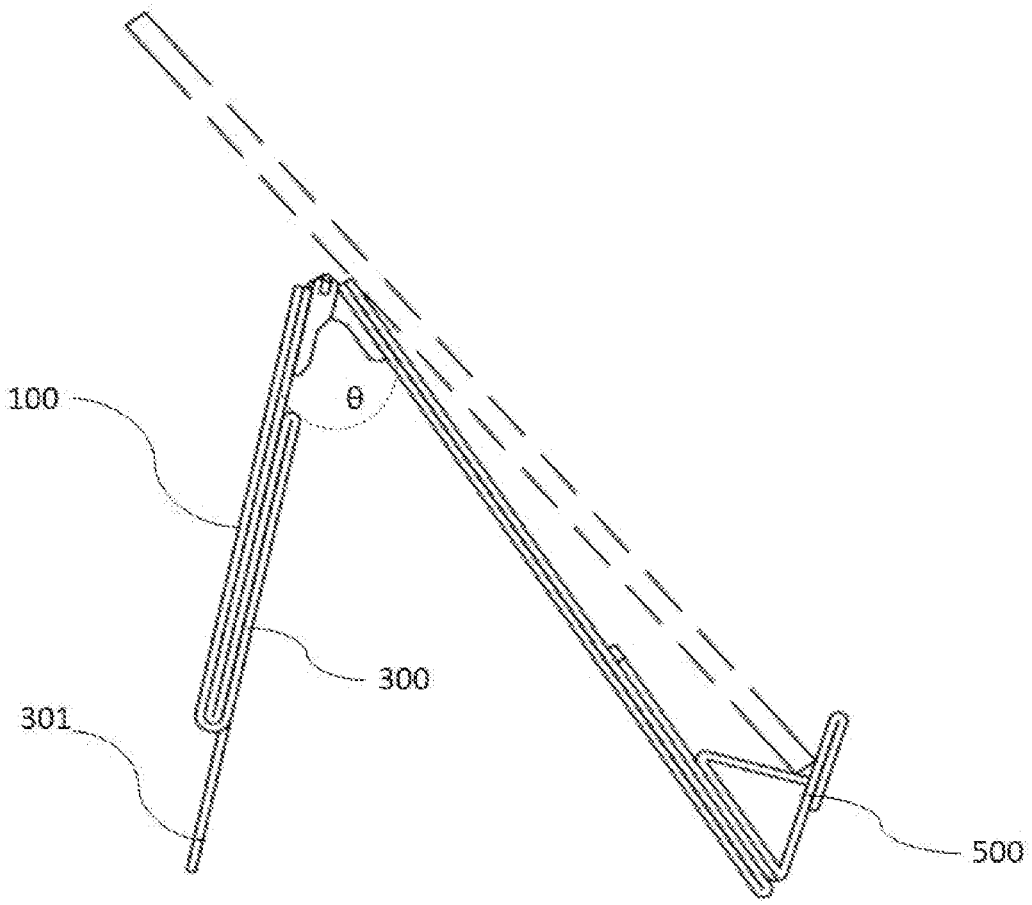
FIG. 7 is a schematic view showing a state of use in accordance with a further embodiment of the present invention.

In FIGS. 3-4, the mobile device display stand structure 1 further includes a bending portion 300, and the first lever 100 is connected to the bending portion 300 by a flexible portion 20, and the bent first lever 100 and the bending portion 300 are attached and fixed to each other by a non-permanent fixing method (as shown in FIGS. 5 and 7). In some embodiments, the bending portion 300 further includes an extension part 301 disposed at an end of the bending portion 300 where the bending portion 300 and the first lever 100 are connected.

Figure 6:
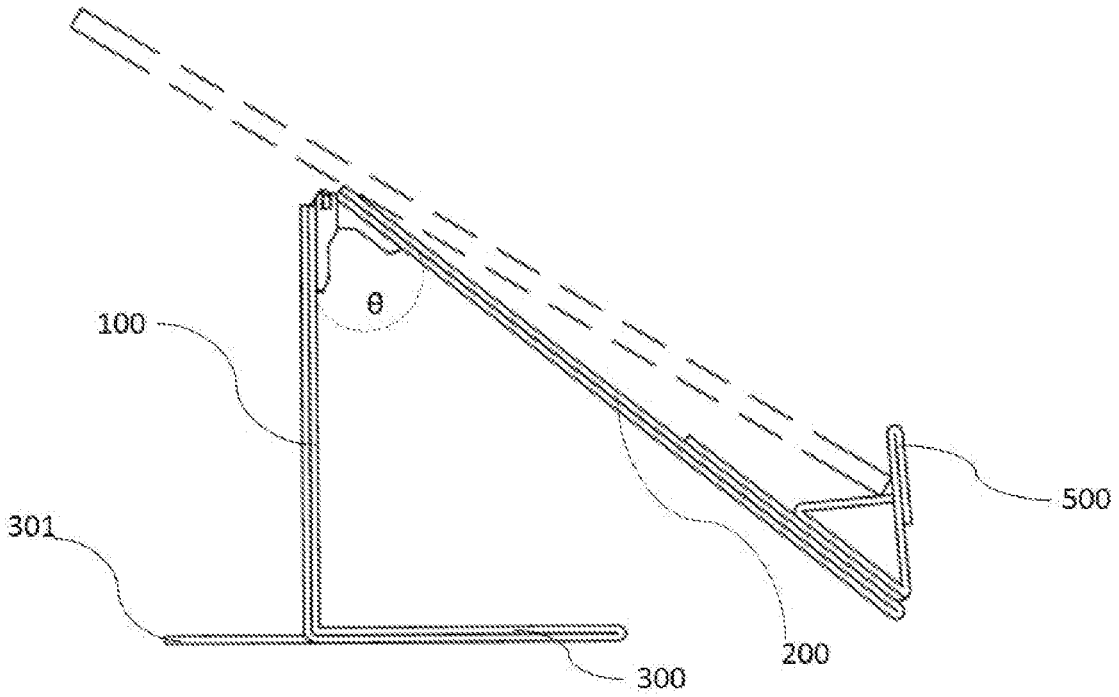
FIG. 6 is a schematic view showing a state of use in accordance with another embodiment of the present invention.
Figure 8:
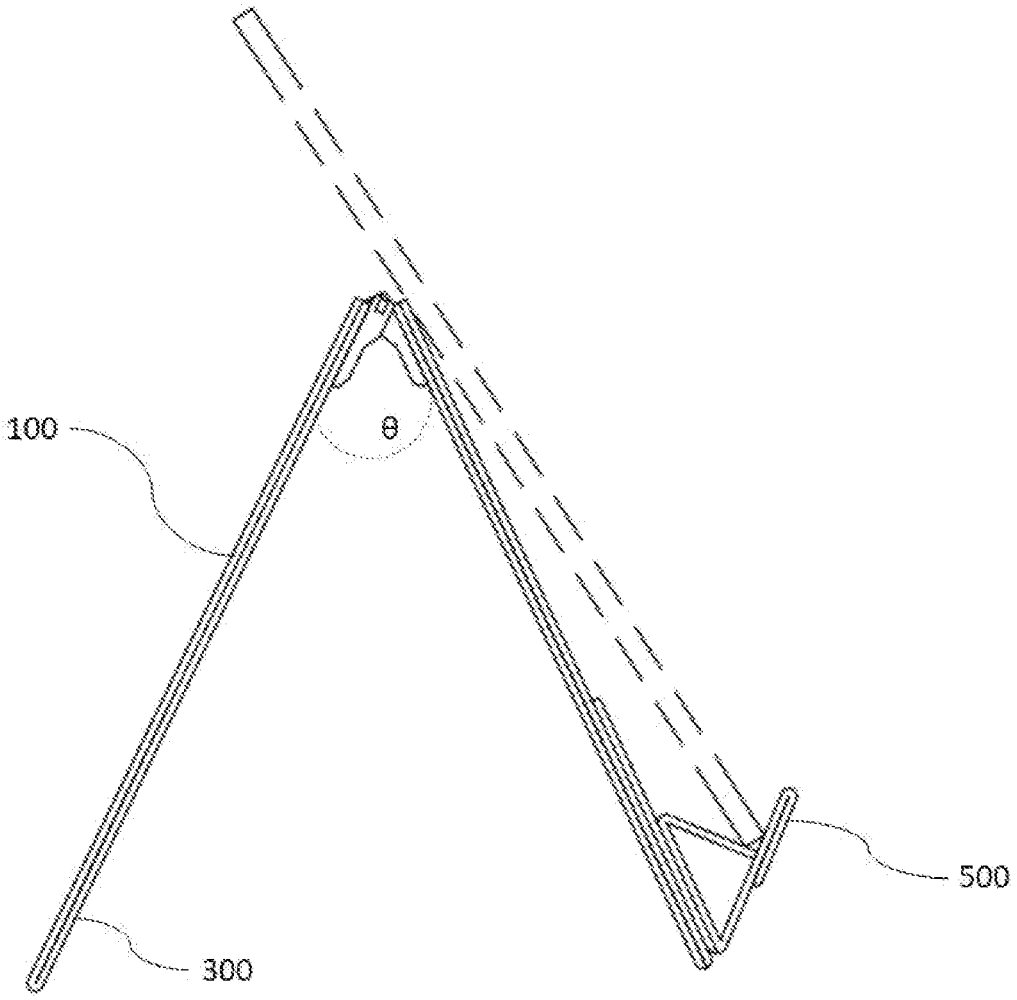
FIG. 8 is a schematic view showing a state of use in accordance with another further embodiment of the present invention.

During the use of the present invention as shown in FIGS. 5-8, a user can fold the first lever 100 and the second lever 200 to define an included angle θ, and freely adjust the included angle θ to the desired angle and height. In the meantime, the user can also fold the bending portion 300 to define various supporting states as shown in FIGS. 5-7. For example, in a supporting state as shown in FIG. 6, the included angle θ is greater than 0 degree, a plane of the bending portion 300 is attached to a horizontal surface, and the bending portion 300 is not attached to the first lever 100. In another supporting state as shown in FIGS. 5 and 7, the included angle θ is greater than 0 degree, a plane of the bending portion 300 is attached to the first lever 100, and a section of the extension part 301 abuts against a horizontal plane. In a further supporting state as shown in FIG. 8, the included angle θ is greater than 0 degree, and an end of the bending portion 300 and an end of the second lever 200 abut against a horizontal plane. During use, the user can lean the object or put the object on the first lever 100 or second lever 200 to achieve the effect of erecting the object.

In FIG. 3, the first lever 100, the second lever 200 and the bending portion 300 can have a magnetic part 400 separately to achieve the effect of fixation. When a side of the bending portion 300 is attached to the first lever 100, the bending portion 300 and the first lever 100 can be fixed to each other by the magnetic parts 400.

In FIG. 5, the mobile device display stand structure 1 of the present invention further includes an add-on part 500 connected and fixed to the first lever 100 or the second lever 200 by a non-permanent fixing method. In FIGS. 6-8, during use, the add-on part 500 can be connected to the first lever 100 or the second lever 200, and the mobile device or other objects can be placed on the mobile device display stand structure 1 and the add-on part 500. Therefore, the user can view the mobile device or the object at different heights and angles.

In summation of the description above, the mobile device display stand structure 1 of the present invention with the aforementioned structural characteristics allows users to store, fold, or unfold the mobile device display stand structure 1. After unfolding the mobile device display stand structure 1, the users can place the object on the first lever 100 or the second lever 200 to facilitate the users to view the object. In addition, the users can also fix a magnetic object to the first lever 100 or the second lever 200 in the supporting state. In some other embodiments, the user can also put a non-magnetic object on the first lever 100 or the second lever 200 in the supporting state. For example, the object is a mobile phone, a piece of notepad paper, etc. When it is not necessary to use the mobile device display stand structure of the present invention, the users can also fold the mobile device display stand structure 1 for storage. The present invention provides a structural design for fixing an object and facilitating users to view or operate the object, so as to greatly improve the users' convenience. Further, the structure of the present invention is plate-shaped, which greatly reduces the storage thickness. Since the structure of the present invention has the magnetic parts, it cannot be unfolded accidentally, and the invention is very convenient to use, store, and carry, thereby further improving the convenience and practicality.

While the invention has been described by means of specific embodiments, numerous modifications and variations could be made thereto by those skilled in the art without departing from the scope and spirit of the invention set forth in the claims.

What is claimed is:

1. A mobile device display stand structure, comprising: a shaft, driven and rotated by applying a critical moment greater than a resistance of the shaft to overcome the resistance of the shaft; and a first lever and a second lever, coupled to the shaft separately, and the first lever and the second lever using the shaft as a fulcrum to flip over relative to each other to define an included angle, and the first lever and the second lever being plate-shaped bodies, characterized in that when the included angle falls within a range of 0-180 degrees, the gravity of the first lever generates a first moment relative to the shaft or the gravity of the second lever generates a second moment smaller than the critical moment relative to the shaft, such that the first lever or the second lever cannot be rotated relative to the shaft and the included angle is kept constant, wherein the mobile device display stand structure further comprises a bending portion, and the first lever is coupled to the bending portion by a flexible portion, and the bent first lever and the bending portion are attached and fixed to each other by a non-permanent fixing method.

2. The mobile device display stand structure according to claim 1, wherein the bending portion further comprises an extension part disposed at an end of the bending portion where the bending portion and the first lever are coupled.

3. The mobile device display structure according to claim 2, wherein in a supporting state, the included angle is greater than 0 degree, a plane of the bending portion is attached to the first lever, and a section of the extension part abuts against a horizontal plane.

4. The mobile device display stand structure according to claim 1, wherein in a supporting state, the included angle is greater than 0 degree, a plane of the bending portion is flatly attached to a horizontal surface, and the bending portion is not attached to the first lever.

5. The mobile device display stand structure according to claim 1, wherein in a supporting state, the included angle is greater than 0 degree, and an end of the bending portion and an end of the second lever abut against a horizontal plane.

6. The mobile device display stand structure according to claim 1, wherein the first lever, the second lever and the bending portion have a magnetic part separately.

7. The mobile device display stand structure according to claim 1, further comprising an add-on part coupled and fixed to the first lever or the second lever by a non-permanent fixing method.

8. A mobile device display stand structure, comprising: a shaft, driven and rotated by applying a critical moment greater than a resistance of the shaft to overcome the resistance of the shaft; and a first lever and a second lever, coupled to the shaft, and using the shaft as a fulcrum to flip over relative to each other by the shaft to define an included angle, and the first lever and the second lever being plate-shaped bodies, characterized in that: when the mobile device display stand structure is placed on a plane and the included angle falls within a range of 0-180 degrees, the sum of a first moment relative to the shaft generated by a resistance greater than the gravity of the first lever, and a second moment relative to the shaft generated by the gravity of the second lever makes the first lever or the second lever unable to rotate relative to the shaft and keeps the included angle constant, wherein the mobile device display stand structure further comprises a bending portion, and the first lever is coupled to the bending portion by a flexible portion, and the bent first lever and the bending portion are attached and fixed to each other by a non-permanent fixing method.

9. The mobile device display stand structure according to claim 8, wherein the bending portion further comprises an extension part disposed at an end of the bending portion where the bending portion and the first lever are coupled.

10. The mobile device display stand structure according to claim 8, wherein in a supporting state, the included angle is greater than 0 degree, a plane of the bending portion is flatly attached to a horizontal surface, and the bending portion is not attached to the first lever.

11. The mobile device display stand structure according to claim 8, wherein in a supporting state, the included angle is greater than 0 degree, a plane of the bending portion is attached to the first lever, and a section of the extension part abuts against a horizontal plane.

12. The mobile device display stand structure according to claim 8, wherein the first lever, the second lever and the bending portion have a magnetic part separately.

13. The mobile device display stand structure according to claim 8, further comprising an add-on part coupled and fixed to the first lever or the second lever by a non-permanent fixing method.

* * * * *